US007808364B2

(12) United States Patent
Chou et al.

(10) Patent No.: US 7,808,364 B2
(45) Date of Patent: Oct. 5, 2010

(54) VARISTOR PROTECTION COVER AND VARISTOR DEVICE

(75) Inventors: Yi-Hsiung Chou, Chung Ho (TW); Yu-Lung Lee, Chung Ho (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 964 days.

(21) Appl. No.: 11/637,870

(22) Filed: Dec. 13, 2006

(65) Prior Publication Data

US 2007/0290786 A1 Dec. 20, 2007

(30) Foreign Application Priority Data

Jun. 5, 2006 (TW) ..... 95209705 A

(51) Int. Cl.
*H01C 7/10* (2006.01)

(52) U.S. Cl. ..... 338/21; 337/183; 337/206; 361/121

(58) Field of Classification Search ..... 338/20, 338/21; 337/183, 184, 186, 206, 241; 361/121, 361/117, 126
See application file for complete search history.

(56) References Cited

U.S. PATENT DOCUMENTS 5,198,791 A * 3/1993 Shibayama et al. ..... 337/31
5,408,379 A * 4/1995 Oguchi et al. ..... 361/55
5,502,612 A * 3/1996 Osterhout et al. ..... 361/117
5,760,336 A * 6/1998 Wang ..... 174/535
5,781,394 A * 7/1998 Lorenz et al. ..... 361/124
6,094,128 A * 7/2000 Bennett et al. ..... 338/21

* cited by examiner

*Primary Examiner*—Kyung Lee
(74) *Attorney, Agent, or Firm*—Rosenberg, Klein & Lee

(57) ABSTRACT

A protection cover used for avoiding the influence brought about by the temperature effect of a varistor is proposed. The protection cover is made of ceramic or refractory material, and is used to bear high temperature generated when a metal oxide varistor breaks down to catch fire and to further cover the fire therein, thereby preventing the fire from burning out application components around the metal oxide varistor. Moreover, accommodation portions and grooves for receiving temperature breakers are disposed on the protection cover to provide a better contact surface between the protection cover and the temperature breakers so that the temperature breakers can more accurately detect the temperature on the protection cover, hence reducing the occurrence of the situation of erroneous actions.

11 Claims, 9 Drawing Sheets

VARISTOR PROTECTION COVER AND VARISTOR DEVICE

BACKGROUND OF THE INVENTION

1. Field of the Invention

The present invention relates to a protection cover and, more particularly, to a protection cover used in varistors.

2. Description of Related Art

Common metal oxide varistors (MOV) can be classified into three categories: SiC, Si Zener diode and ZnO. Ceramic bipolar varistors formed by sintering ZnO powder at high temperatures have a nonlinear resistance-versus-voltage relation. They have a very high resistance that can block the passage of current at low voltages, but their resistance drops drastically to allow the passage of large currents at high voltages. This characteristic has been widely applied in the voltage regulation and the suppression of transient surge of electronic circuits and power systems such as communication equipments, consumer electronic products, industrial machines and power distribution and transmission devices.

When the MOV continually receives a high voltage or the received voltage exceeds the bearable rated value, a large amount of heat will be generated or even fire is caught. In an electronic circuit, temperature has very high influence to the properties of electronic components. High temperature may cause abnormal operations of the circuit or even cause the circuit not to work, not mentioning the influence of fire to the electronic components.

The influence to the circuit of high temperature caused by the MOV that is damaged by high voltages can usually be reduced through the protection of a temperature breaker. The temperature breaker is adhered onto the surface of the MOV to detect the temperature of the MOV. If the MOV is damaged to cause a rise in temperature or to further catch fire, the temperature breaker will cut off the power of the circuit to avoid hazards once detecting the high temperature.

The adhesion between a common MOV and the temperature breaker, however, is not good enough. There exist gaps between them. The temperature breaker cannot accurately detect the temperature because of the existence of gaps. The situation that the temperature breaker does not work when the temperature is high enough to influence the circuit may arise. Besides, when the temperature breaker is adhered onto the surface of the MOV, if the MOV is burned out instantaneously under a high voltage, the temperature breaker may also be burned out instantaneously and therefore cannot cut off the working power, hence being not able to exactly protect the circuit.

SUMMARY OF THE INVENTION

An object of the present invention is to provide a protection cover, which is made of ceramic or refractory material to bear high temperature generated when a varistor breaks down to catch fire and to further cover the fire therein, thereby preventing the fire from burning out application components around the metal oxide varistor. Moreover, accommodation portions and grooves for receiving temperature breakers are disposed on the protection cover to provide a better contact surface between the protection cover and the temperature breakers so that the temperature breakers can more accurately detect the temperature on the protection cover, hence reducing the occurrence of the situation of erroneous actions.

To achieve the above object, the present invention provides a protection cover of a varistor. The protection cover has a temperature breaker. When the temperature of the varistor is too high, the circuit connected with the varistor can be broken. The temperature breaker can be disposed outside or inside the protection cover, and the number of the temperature breaker is not limited.

The present invention also provides a varistor device, which comprises a varistor module and a protection cover. The protection cover covers on the varistor module to avoid the influence brought about by high temperature or fire caused by a too high voltage across the varistor module.

BRIEF DESCRIPTION OF THE DRAWINGS

The various objects and advantages of the present invention will be more readily understood from the following detailed description when read in conjunction with the appended drawing, in which.

DETAILED DESCRIPTION OF THE PREFERRED EMBODIMENTS

Figure 1:
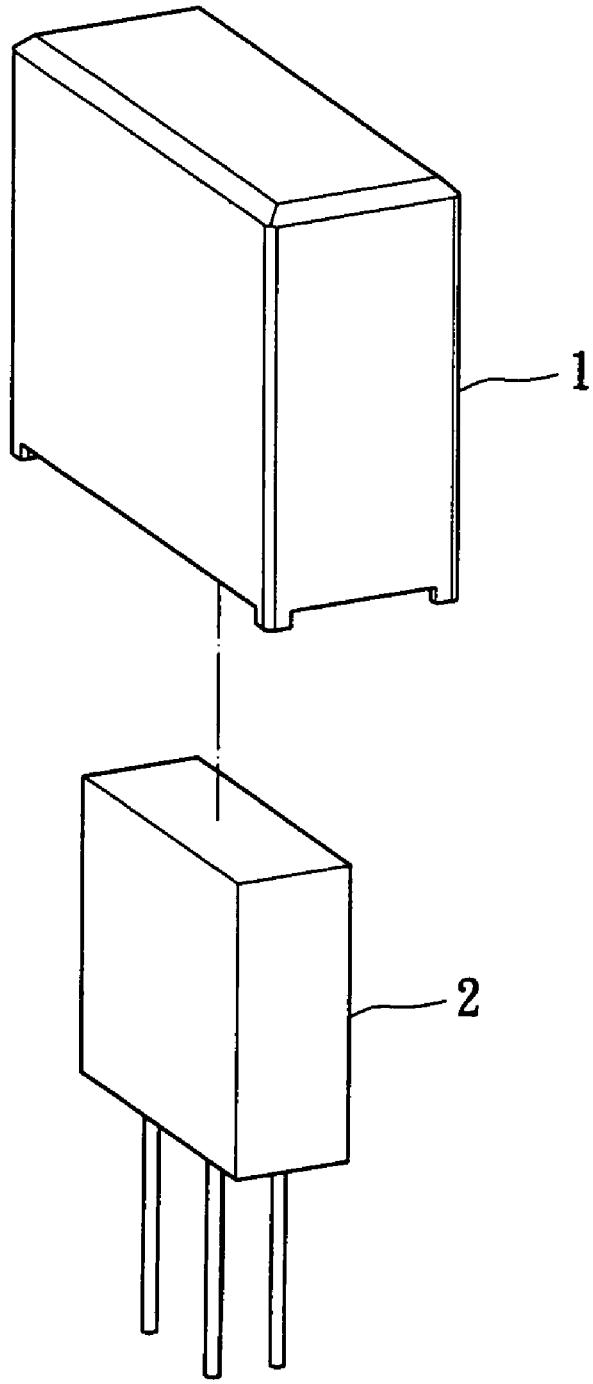
FIG. 1 is a perspective view of the varistor device according to a first preferred embodiment of the present invention.

In a circuit, high temperature or a continual high voltage generated due to damage of a varistor (e.g., a metal oxide varistor, MOV) will further damage components around the varistor. In order to avoid this situation, the present invention provides a protection cover 1 with flat surfaces, as shown in FIG. 1. FIG. 1 is a perspective view of the varistor device according to a first preferred embodiment of the present invention. The protection cover 1 covers on a varistor module 2. The protection cover 1 is made of ceramic or refractory material with refractory characteristic, and can bear at least as high as 1000° C. The protection cover 1 can also quickly spread heat therein to the outside. In addition to having a good heat radiating effect, the protection cover 1 can also control the fire of the varistor module that is on fire in the protection cover 1 to exactly protect electronic components around the varistor module 2. At least a temperature breaker can be disposed outside or inside the protection cover 1 to protect the varistor module 2.

Figure 2:
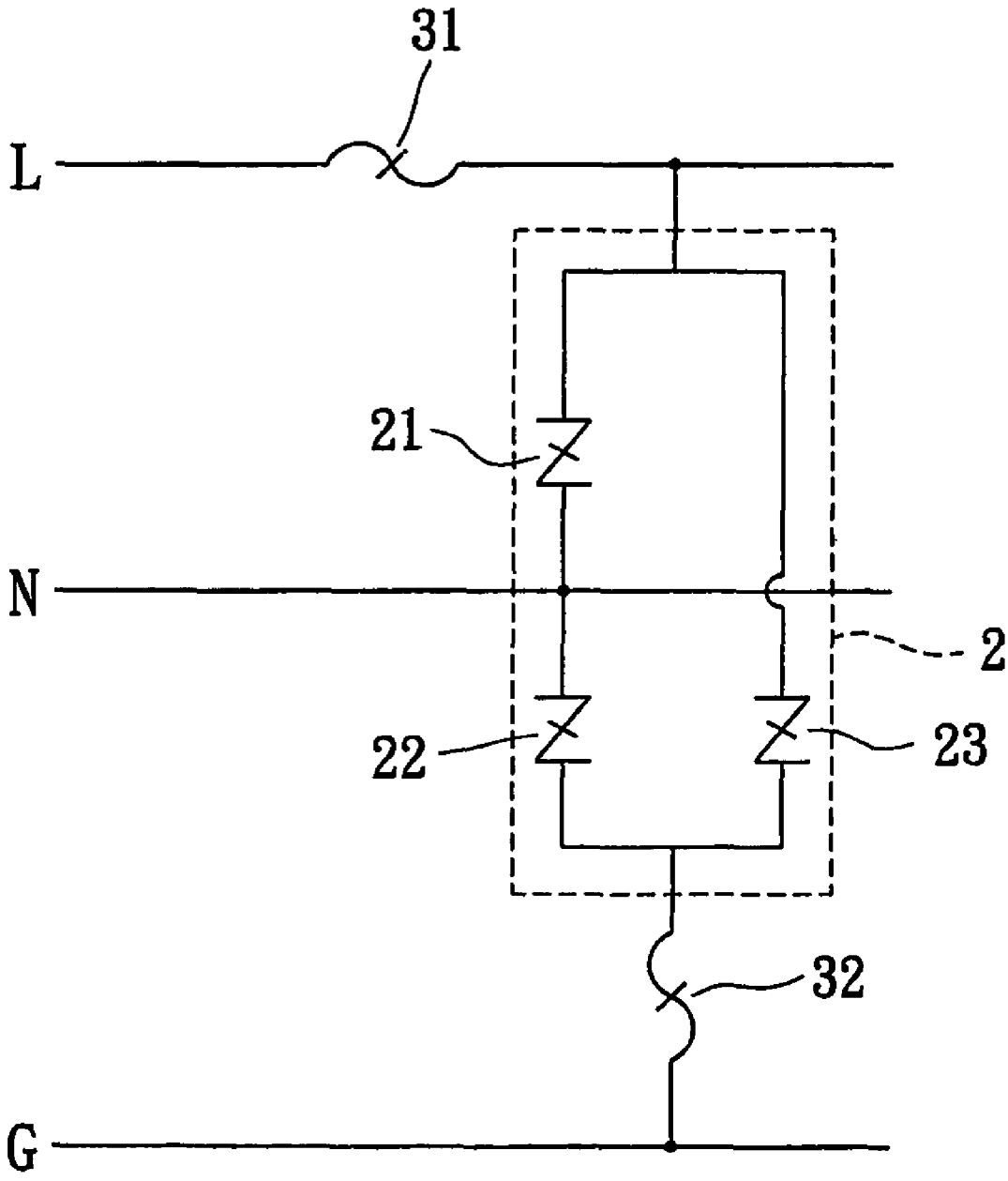
FIG. 2 is an application circuit diagram of a varistor.

As shown in FIG. 2, the varistor module 2 comprises three varistors 21, 22 and 23 (the number of MOVs is not limited in the present invention). A first temperature breaker 31 is disposed at the L terminal of the three-phase circuit, and is connected to the varistor module 2. The varistor module 2 is connected to the G terminal of the three-phase circuit via a second temperature breaker 32. The first and second temperature breakers 31 and 32 are used for protection through breaking at high temperatures to avoid the influence caused by the burnout of these varistors 21, 22 and 23. The present invention proposes the protection cover 1 to provide a better way of temperature detection for the first and second temperature breakers 31 and 32 so as to exactly protect the components and circuits.

Figure 3:
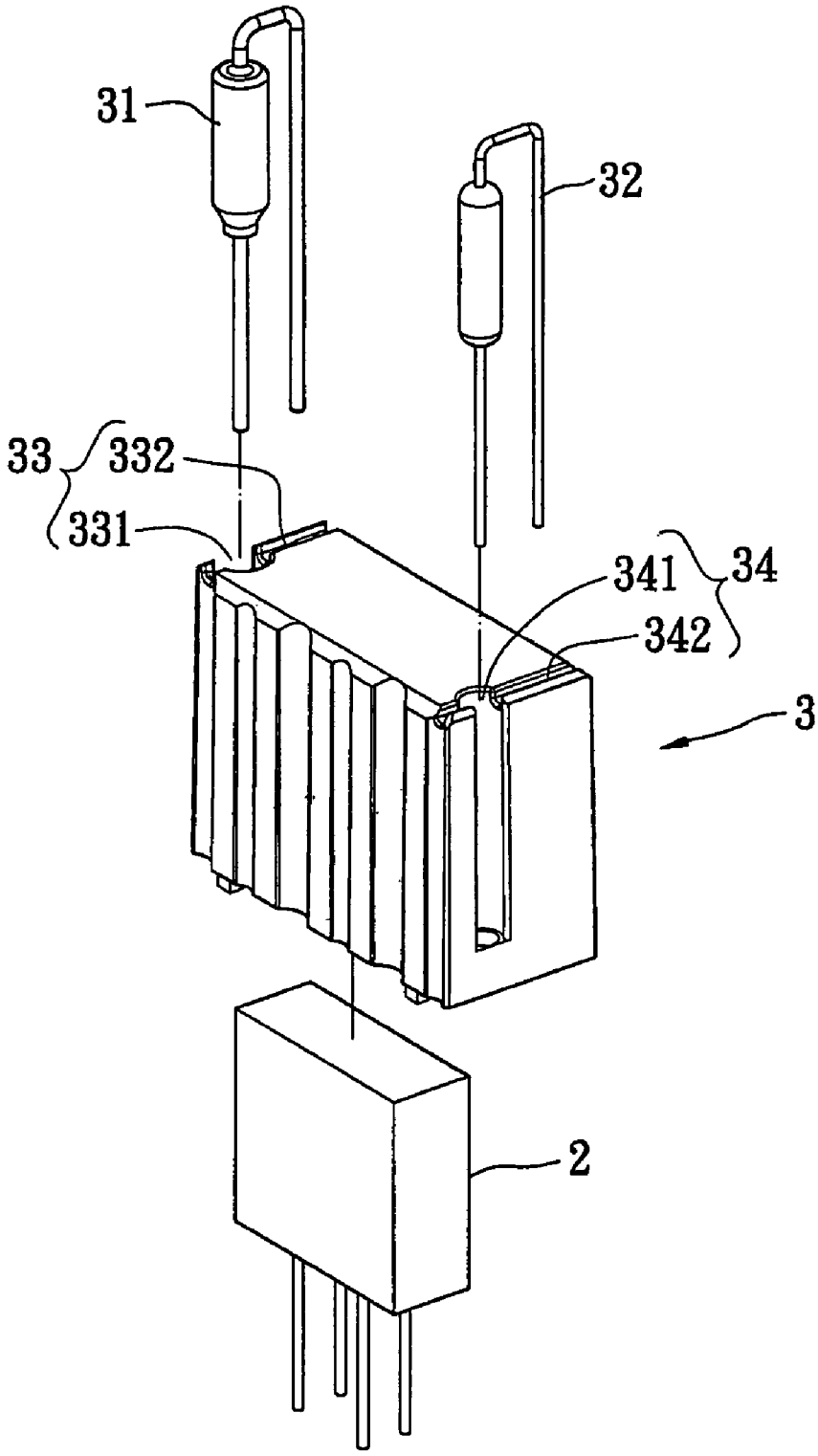
FIG. 3 is an exploded perspective view of the varistor device according to a second preferred embodiment of the present invention.

As shown in FIG. 3, the first temperature breaker 31 is installed in a first accommodation portion 33 on the protection cover 3, the second temperature breaker 32 is installed in a second accommodation portion 34 on the protection cover 3, and the protection cover 3 covers on the varistor module 2. If the varistor module 2 catches fire due to a continual high voltage, the fire can be controlled in the protection cover 3. Because the protection cover 3 of the present invention is made of ceramic or refractory material with refractory characteristic, it can bear as high as 1000° C. The protection cover 3 can also quickly spread heat therein to the outside, as the function of common heat radiators. This heat-radiating characteristic can also help the first and second temperature breakers 31 and 32 work normally. Common temperature breakers need a period of time to respond. Because the refractory protection cover 3 slows down the influence caused by high temperature and controls high temperature therein and quickly spread heat therein to the outside, the time required for the response of the first and second temperature breakers 31 and 32 can be assured. Therefore, when high temperature is generated in the protection cover 3, the first and second temperature breakers 31 and 32 won't be directly affected by the high temperature to deteriorate their original properties or burn out, and can accurately do their protection job.

Figure 4:
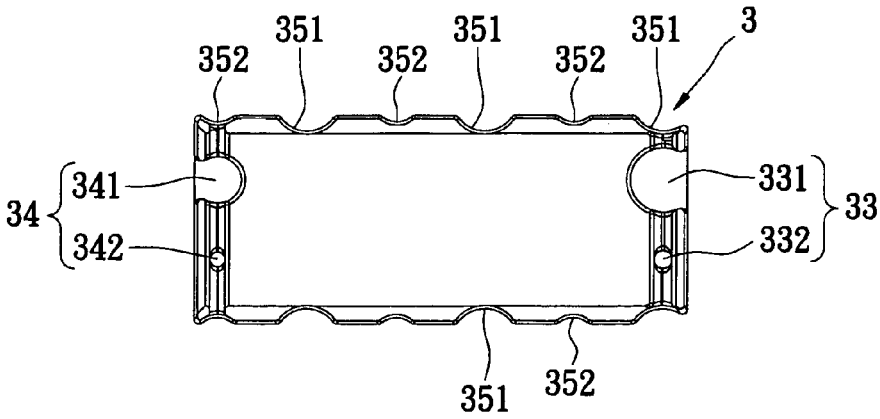
FIG. 4 is a top view of the varistor protection cover according to the second preferred embodiment of the present invention.

FIG. 4 is a top view of the varistor protection cover according to the second preferred embodiment of the present invention. As shown in FIG. 4, the first accommodation portion 33 is located on one side of the protection cover 3, and has a first body accommodation groove 331 and a first conducting wire hole 332 to receive the first temperature breaker 31. The first body accommodation groove 331 is used to receive the main body of the first temperature breaker 31, and the first conducting wire hole 332 is passed by the conducting wire of the first temperature breaker 31. The second accommodation portion 34 is located on another side of the protection cover 3, and has a second body accommodation groove 341 and a second conducting wire hole 342 to receive the second temperature breaker 32. The second body accommodation groove 341 is used to receive the main body of the second temperature breaker 32, and the second conducting wire hole 342 is passed by the conducting wire of the second temperature breaker 32.

A plurality of grooves is disposed on other two sides (or another side) of the protection cover 3. These grooves include first grooves 351 for receiving the first temperature breaker 31 and second grooves 352 for receiving the second temperature breaker 32. The first and second grooves 351 and 352 are alternately arranged, but the present invention is not limited to this kind of arrangement.

The reason why the first and second accommodation portions 33 and 34 and the first and second grooves 351 and 352 are disposed in the protection cover 3 of the present invention is to provide a better fixing way so as to provide a better contact surface between the protection cover 3 and the temperature breakers 31 and 32. The first and second temperature breakers 31 and 32 can thus directly contact the protection cover 3 to more accurately detect the temperature on the ceramic protection cover 3.

Figure 5:
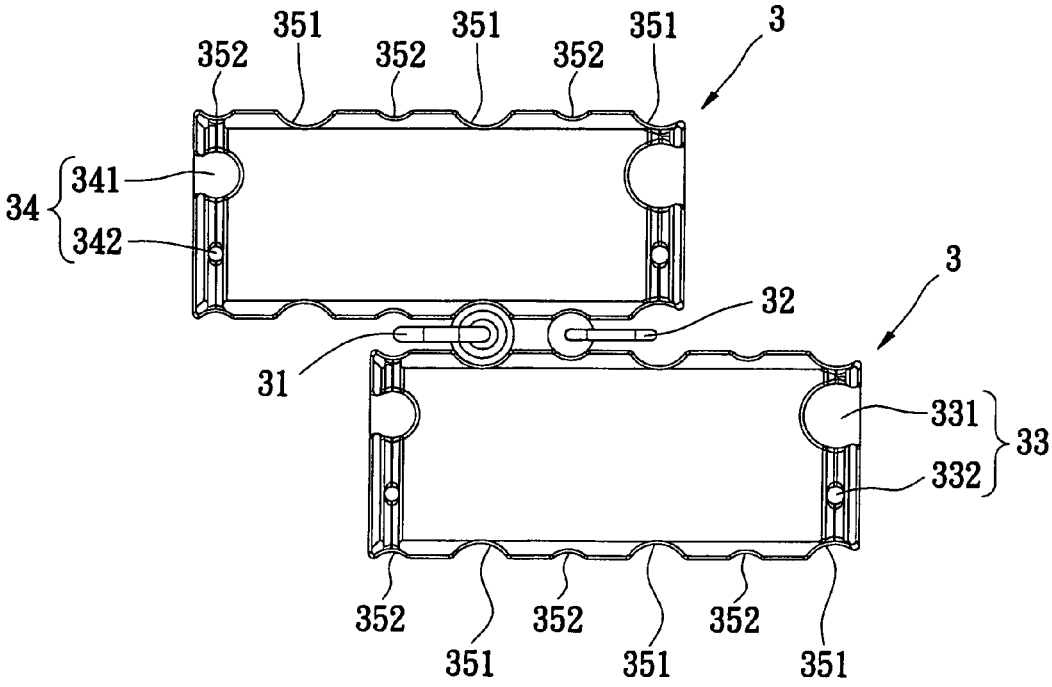
FIG. 5 is a top view of the varistor device according to the second preferred embodiment of the present invention.

As shown in FIG. 5, if two varistor modules 2 are simultaneously used in an application circuit, two protection covers 3 will be used to avoid abnormal high temperature in these two varistor modules 2. It is not necessary to provide two temperature breakers in the two protection covers 3. As shown in FIG. 5, the first temperature breaker 31 and the second temperature breaker 32 are disposed between the two protection covers 3 to simultaneously detect the temperatures of the two protection covers 3. Through the grooves 351 and 352 disposed between the two protection covers 3, a better fixing way and a better contact surface can be provided to allow the first and second temperature breakers 31 and 32 to more accurately detect the temperatures of the two protection covers 3.

The present invention also provides an embodiment of a protection cover, in which whether the accommodation portion is disposed on one side or two sides of the protection cover to receive the temperature breaker is not limited.

Figure 6:
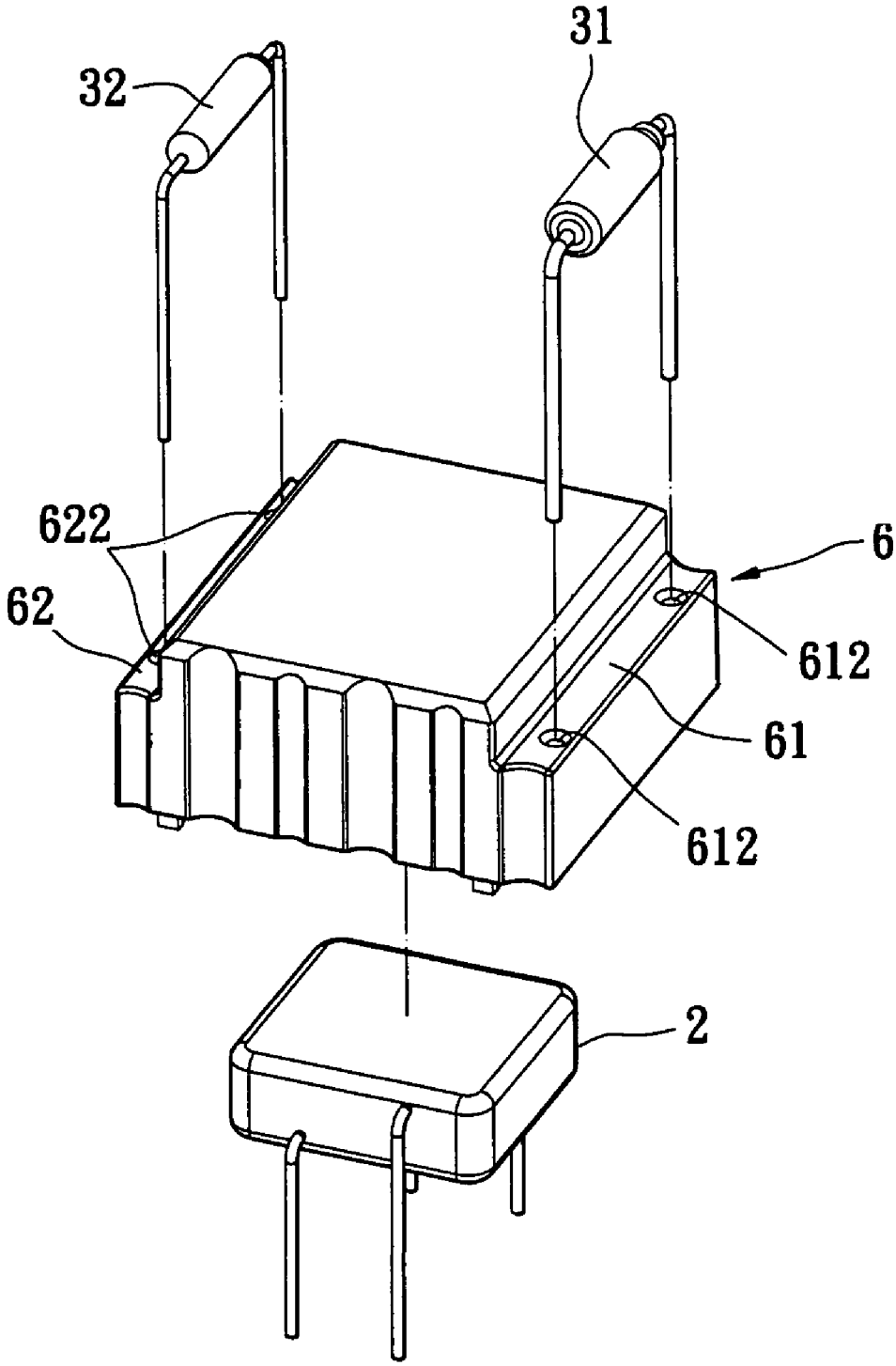
FIG. 6 is an exploded perspective view of the varistor device according to a third preferred embodiment of the present invention.

FIG. 6 is an exploded perspective view of the varistor device according to a third preferred embodiment of the present invention. As shown in FIG. 6, the first temperature breaker 31 is installed in the first accommodation portion 61 on the protection cover 6, the second temperature breaker 32 is installed in the second accommodation portion 62 on the protection cover 6, and the protection cover 6 covers on the varistor module 2. If the varistor module 2 catches fire due to a continual high voltage, the fire can be controlled in the protection cover 6. The heat-radiating characteristic of the ceramic or refractory protection cover 6 can help the first and second temperature breakers 31 and 32 work normally. Common temperature breakers need a period of time to respond. Because the ceramic protection cover 6 slows down the influence caused by high temperature and controls high temperature therein and quickly spread heat therein to the outside, the time required for the response of the first and second temperature breakers 31 and 32 can be assured. Therefore, when high temperature is generated in the protection cover 6, the first and second temperature breakers 31 and 32 won't be directly affected by the high temperature to deteriorate their original properties or burn out, and can accurately do their protection job.

Figure 7:
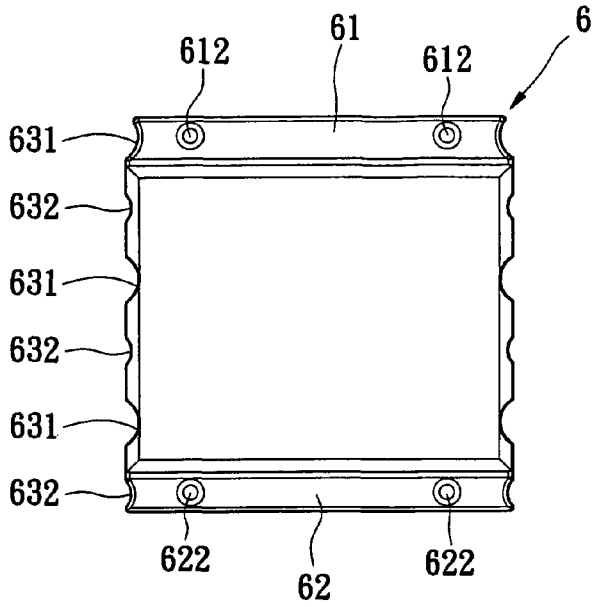
FIG. 7 is a top view of the varistor protection cover according to the third preferred embodiment of the present invention.

FIG. 7 is a top view of the varistor protection cover according to the third preferred embodiment of the present invention. As shown in FIG. 7, the first accommodation portion 61 is located at the top of one side of the protection cover 6, and has two first conducting wire holes 612 to receive the first temperature breaker 31. The first accommodation portion 61 is used to receive the main body of the first temperature breaker 31, which contacts the protection cover 6 to detect the temperature on the protection cover 6. The first conducting wire holes 612 are passed by the conducting wire of the first temperature breaker 31. The second accommodation portion 62 is located at the top of another side of the protection cover 6, and has two second conducting wire holes 622 to receive the second temperature breaker 32. The second accommodation portion 62 is used to receive the main body of the second temperature breaker 32, and the second conducting wire holes 622 are passed by the conducting wire of the second temperature breaker 32.

A plurality of grooves is disposed on other two sides (or another side) of the protection cover 6. These grooves include first grooves 631 for receiving the first temperature breaker 31 and second grooves 632 for receiving the second temperature breaker 32. The first and second grooves 631 and 632 are alternately arranged, but the present invention is not limited to this kind of arrangement.

Figure 8:
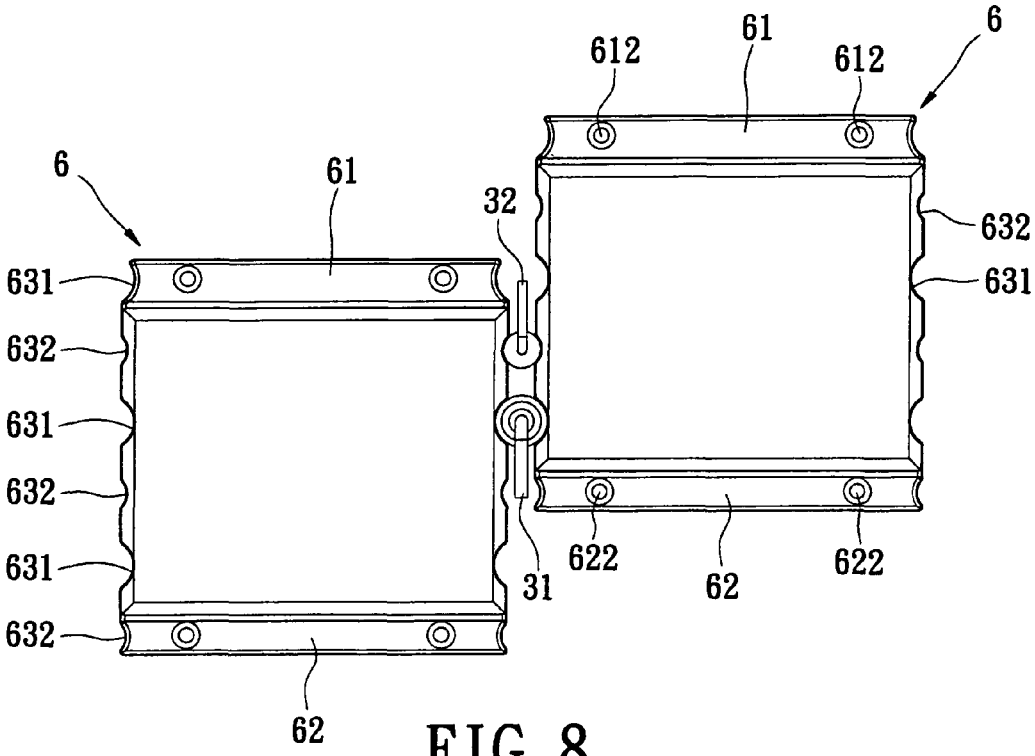
FIG. 8 is a top view of the varistor device according to the third preferred embodiment of the present invention.

As shown in FIG. 8, if two varistor modules 2 are simultaneously used in an application circuit, two protection covers 6 will be used to avoid abnormal high temperature in these two varistor modules 2. As shown in FIG. 8, the first temperature breaker 31 and the second temperature breaker 32 are disposed between the two protection covers 6 to simultaneously detect the temperatures of the two protection covers 6. Through the grooves 631 and 632 disposed between the two protection covers 6, a better fixing way and a better contact surface can be provided to allow the first and second temperature breakers 31 and 32 to more accurately detect the temperatures of the two protection covers 6.

Both the above first and second temperature breakers 31 and 32 are thermal activation fuses. When the temperature of the protection cover 6 exceeds a preset value, the temperature breakers will cut off the power to protect the circuit and avoid hazards.

Figure 9:
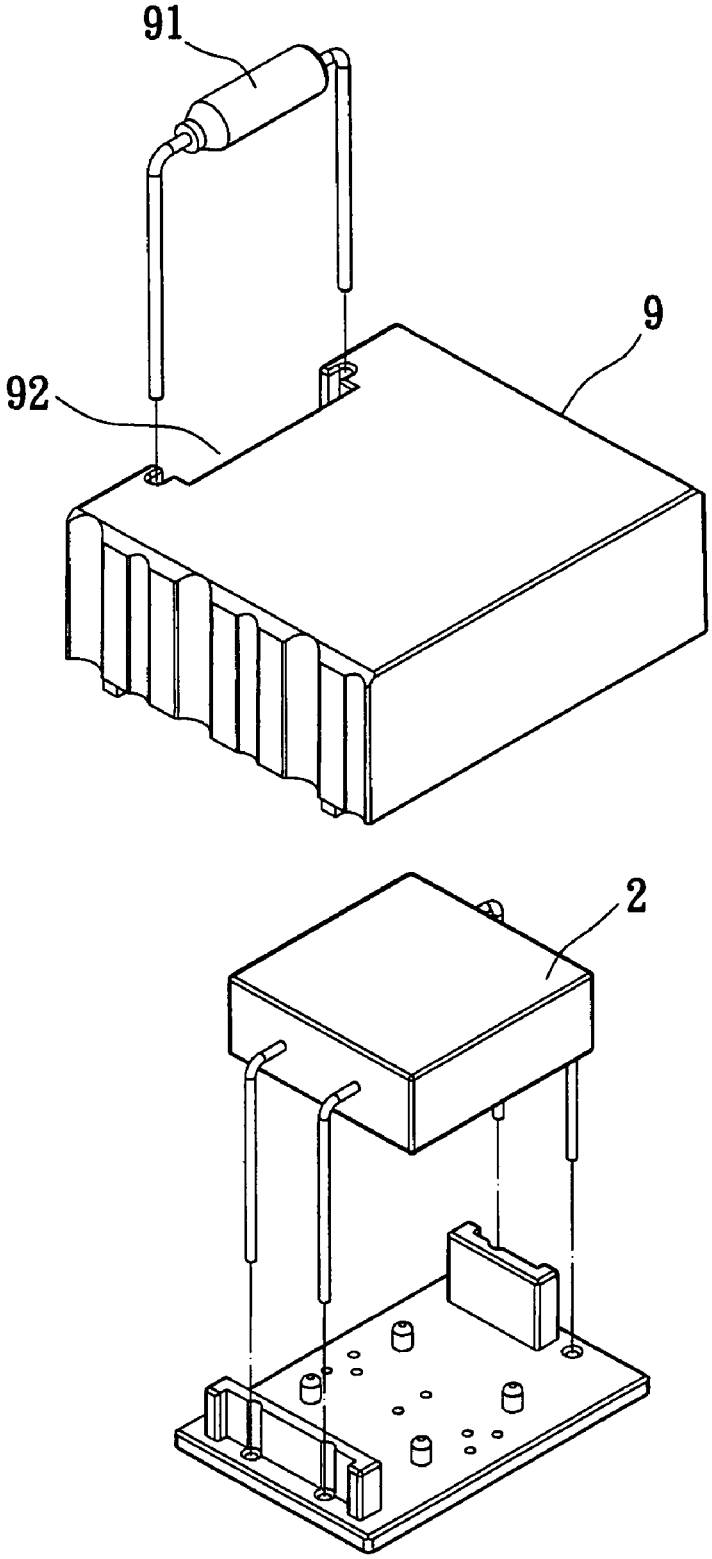
FIG. 9 is an exploded perspective view of the varistor device according to a fourth embodiment of the present invention.

FIG. 9 is an exploded perspective view of the varistor device according to a fourth embodiment of the present invention. As shown in FIG. 9, an accommodation portion 92 is disposed on one side of the protection cover 9 to receive a temperature breaker 91. That is, whether the accommodation portion is disposed on one side or two sides of the protection cover to receive temperature breaker is not limited in the present invention.

Figure 10:
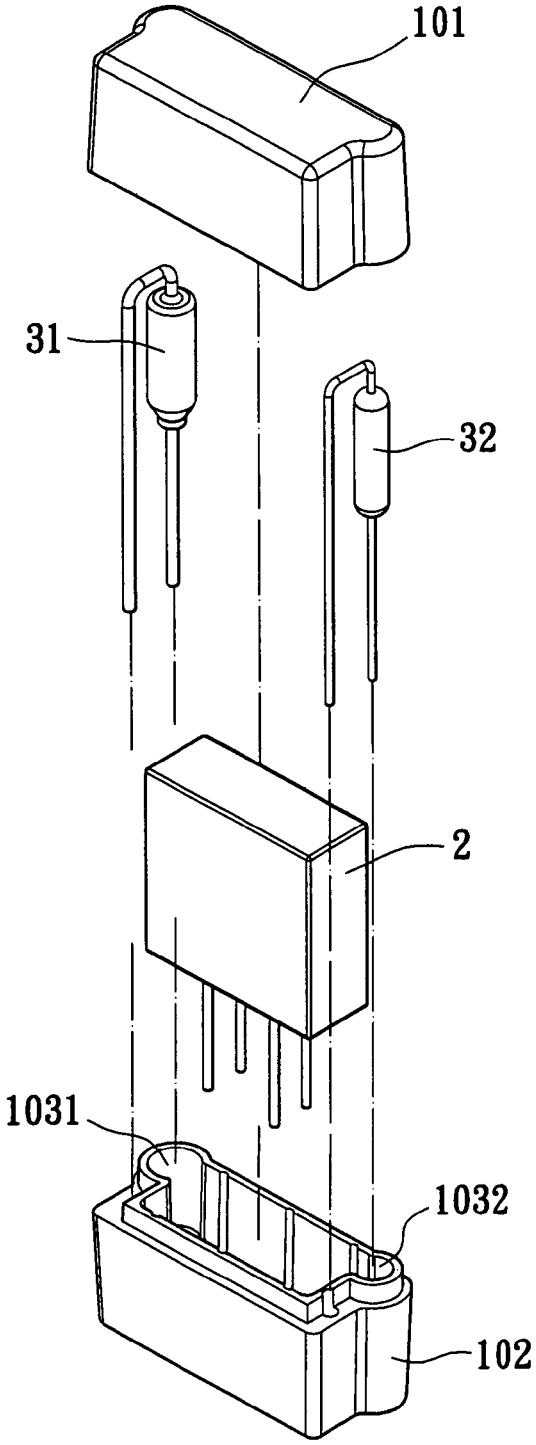
FIG. 10 is an exploded perspective view of the varistor device according to a fifth embodiment of the present invention.

FIG. 10 is an exploded perspective view of the varistor device according to a fifth embodiment of the present invention. As shown in FIG. 10, the first temperature breaker 31, the second temperature breaker 32 and the MOV module 2 are covered in a first protection cover 101 and a second protection cover 102. The first protection cover 101 and the second protection cover 102 have a first body accommodation groove 1031 and a second body accommodation groove 1032 to receive the first temperature breaker 31 and the second temperature breaker 32, respectively. If the varistor module 2 catches fire due to a continual high voltage, the fire can be controlled in the first protection cover 101 and the second protection cover 102. Moreover, when the first temperature breaker 31 and the second temperature breaker 32 detect the high temperature of fire, they can break the related power circuit connected with the varistor module 2 to achieve the object of protecting related components and circuits.

Figure 11:
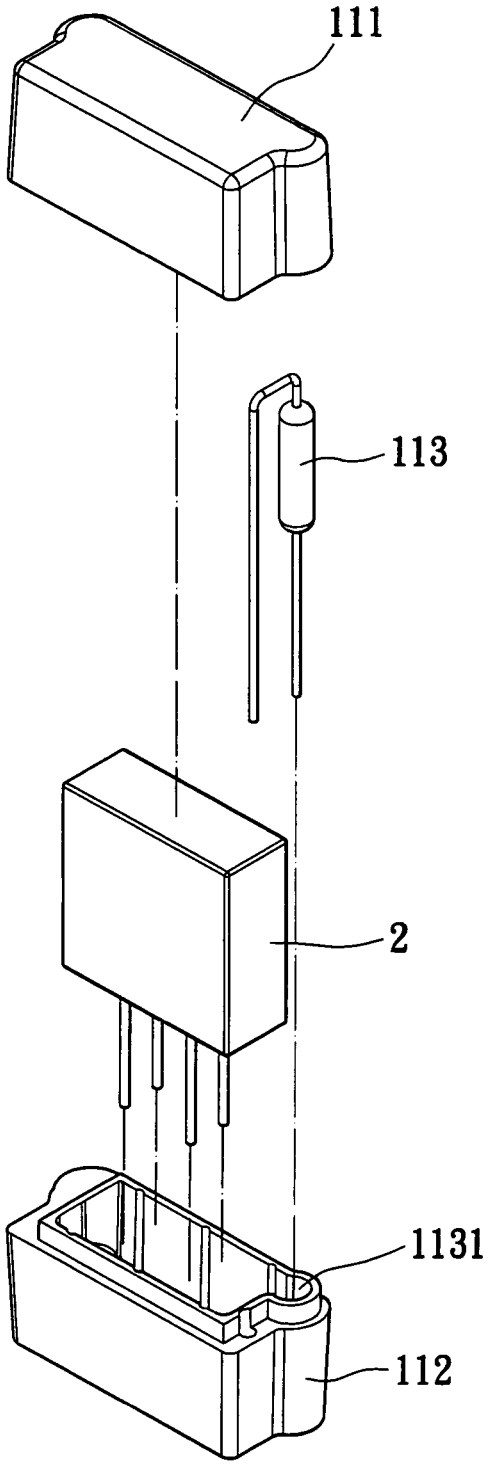
FIG. 11 is an exploded perspective view of the varistor device according to a sixth embodiment of the present invention.

FIG. 11 is an exploded perspective view of the varistor device according to a sixth embodiment of the present invention. As shown in FIG. 11, an accommodation groove 1131 is disposed in a first protection cover 111 and a second protection cover 112 to receive a temperature breaker 113 for protection.

To sum up, the protection cover of the present invention can have at least a temperature breaker (which is not necessarily disposed outside or inside the protection cover) to more directly and accurately detect the temperature, and can prevent the temperature breaker from being burned out by high temperature fire so that the temperature breaker can effectively accomplish the protection function.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

What is claimed is:

1. A protection cover of a varistor, said protection cover having a temperature breaker, said temperature breaker being able to break a circuit connected with said varistor when a temperature of said varistor is too high, said protection cover having accommodation portions disposed external thereto and at both sides of said protection cover to receive said temperature breakers therein.

2. The protection cover as claimed in claim 1, wherein one side surface of said protection cover is a surface having a plurality of grooves or a plain surface.

3. A varistor device comprising:

a varistor module; and a protection cover covering on said varistor module, one outside surface of said protection cover having a plurality of grooves formed therein, said grooves include a first groove for receiving a first temperature breaker and a second groove for receiving a second temperature breaker.

4. The varistor device as claimed in claim 3, wherein said protection cover is made of ceramic material.

5. The varistor device as claimed in claim 3, wherein said protection cover is made of refractory material.

6. The varistor device as claimed in claim 3, wherein said varistor module includes at least a metal oxide varistor (MOV).

7. The varistor device as claimed in claim 3, wherein said first grooves and said second grooves are alternately arranged.

8. A varistor device comprising:

a varistor module; and a protection cover covering on said varistor module, said protection cover having a first accommodation portion disposed on one side thereof, said first accommodation portion including:

a first body accommodation groove for receiving a body of a first temperature breaker; and a first conducting wire hole passed through by a conducting wire of said first temperature breaker.

9. The varistor device as claimed in claim 8, wherein said protection cover further comprises a second accommodation portion disposed on another side of said protection cover, and said second accommodation portion including:

a second body accommodation groove for receiving a body of a second temperature breaker; and a second conducting wire hole passed through by a conducting wire of said second temperature breaker.

10. A varistor device comprising:

a varistor module; and a protection cover covering on said varistor module, said protection cover having a first accommodation portion disposed at a top of one side of said protection cover, and said first accommodation portion having a plurality of first conducting wire holes through which conducting wires of a first temperature breaker are passed.

11. The varistor device as claimed in claim 10, wherein said protection cover further comprises a second accommodation portion disposed at a top of another side of said protection cover, and said second accommodation portion having a plurality of second conducting wire holes through which conducting wires of a second temperature breaker are passed.

* * * * *